United States Patent [19]

Lengyel et al.

[11] 4,018,720

[45] Apr. 19, 1977

[54] LAUNDRY DETERGENT COMPOSITIONS IN EMULSION/SUSPENSION

[75] Inventors: Stephen Price Lengyel, Bridgewater, N.J.; Toshiyuki Ishige, Hirakata, Japan

[73] Assignee: The Procter & Gamble Company, Cincinnati, Ohio

[22] Filed: July 14, 1975

[21] Appl. No.: 595,817

[52] U.S. Cl. ..... 252/534; 252/140; 252/173; 252/179; 252/531; 252/532; 252/553; 252/DIG. 14

[51] Int. Cl.[2] ..... C11D 1/29; C11D 1/37; C11D 3/065; C11D 17/08

[58] Field of Search ..... 252/DIG. 14, 531, 532, 252/534, 550, 551, 553, 173, 89, 131, 140, 179

[56] References Cited

UNITED STATES PATENTS

| | | | |
|---|---|---|---|
| 2,581,677 | 1/1952 | Machlis | 252/534 X |
| 3,085,982 | 4/1963 | Steer | 252/534 X |
| 3,192,166 | 6/1965 | Smith | 252/534 X |
| 3,211,660 | 10/1965 | Marion | 252/534 X |
| 3,235,505 | 2/1966 | Tuvell | 252/135 |
| 3,242,092 | 3/1966 | Bechtold | 252/534 |
| 3,332,876 | 7/1967 | Walker | 252/534 X |
| 3,346,504 | 10/1967 | Herrmann | 252/526 |
| 3,346,873 | 10/1967 | Herrmann | 252/526 |
| 3,501,409 | 3/1970 | Matson | 252/553 X |
| 3,513,099 | 5/1970 | Hans | 252/553 X |
| 3,634,271 | 2/1972 | Friedman | 252/526 X |
| 3,813,349 | 5/1974 | Wolfson | 252/526 |

*Primary Examiner*—Dennis L. Albrecht
*Attorney, Agent, or Firm*—William H. Gould; Richard C. Witte; Thomas H. O'Flaherty

[57] ABSTRACT

A heavy duty laundry liquid detergent composition in the form of an aqueous emulsion/suspension contains, as surfactant, alkyl sulfate or alkyl ether sulfate plus branched chain alkyl benzene sulfonate in specified proportions; one or more phosphate salts as builder; and alkali metal sulfate as stabilizing agent.

28 Claims, 1 Drawing Figure

AMOUNTS OF SURFACTANTS

Figure 1:
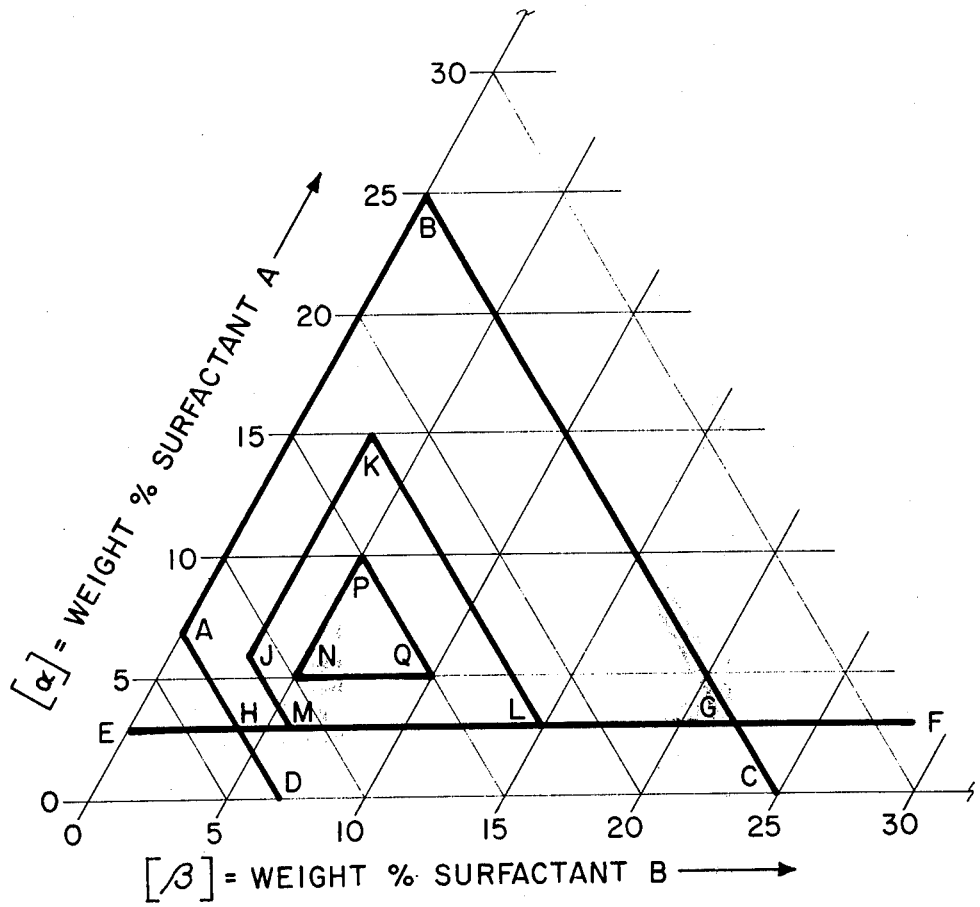

[All other components being present in amounts within the scope of the invention]

AMOUNTS OF SURFACTANTS

[All other components being present in amounts within the scope of the invention]

LAUNDRY DETERGENT COMPOSITIONS IN EMULSION/SUSPENSION

BACKGROUND OF THE INVENTION

This invention relates to the field of heavy duty laundry detergents in liquid form. More specifically it relates to a laundry detergent in the form of a stable, built opaque, viscous liquid in emulsion form, containing suspended solids.

Laundry products in liquid form have been known for some time, but they have never enjoyed the same degree of popularity and commercial success as laundry products in granular form.

One category of liquid laundry products is the optically clear, single phase liquid. Included in this category, for purposes of this disclosure, are compositions all of whose major constituents are present in completely dissolved form but which contain minor amounts, usually below 1%, of suspended material which visually opacifies the product, such as carboxymethyl cellulose or a polymeric emulsion. Such a composition will be referred to hereinafter as a predominantly single phase composition.

One kind of predominantly single phase composition that has been sold for many years consists principally of surfactant, phosphate builder, hydrotrope and water. Typically the surfactant is anionic, the phosphate is tetrapotassium pyrophosphate, and the hydrotrope is potassium toluene sulfonate. Pyrophosphate has been generally preferred to triphosphate as builder because when dissolved in water it exhibits greater chemical stability toward reversion, i.e. toward breakdown to orthophosphate, especially when stored at temperatures above the ambient. To obtain compatibility and mutual solubility between the surfactant and builder a hydrotrope is required which is expensive and yet does not contribute toward the end use of the product, i.e. toward detergency, stain removal sudsing or the like. Even so, expensive potassium builders rather than sodium builders are required to obtain the requisite mutual solubility.

A second kind of predominantly single phase liquid composition has appeared on the commercial scene more recently. Typically it contains a mixture of nonionic and anionic surfactants, the latter being present as the triethanolamine salts, and substantial amounts of free triethanolamine. Such a formula suffers from a lack of builder in the usual sense, i.e. it contains no builders that complex or precipitate $Ca^{++}$ and $Mg^{++}$ hardness, either inorganic builders such as a complex phosphate (e.g. triphosphate) or organic builders such as an aminopolycarboxylate (e.g. nitrilotriacetic acid). In addition, relatively large amounts of expensive triethanolamine is required, both in the form of the free base and as the neutralizing cation for the anionic surfactant acid.

A second category of liquid laundry products in the prior art is mull. This consists primarily of colloidal particles of builder suspended in a nonaqueous liquid vehicle. Typically the builder is sodium triphosphate and the vehicle is nonionic surfactant or a mixture of a nonionic surfactant plus a glycol. A detergent mull requires specialized and expensive methods of preparation, and it requires expensive nonaqueous liquid as the vehicle, rather than water. Also, upon contact with small proportions of water during storage or in use, a detergent mull tends strongly to form large crystals and/or gel structures which neither dispense well from the container nor dispense well in the laundering bath. For these reasons the mull has not enjoyed commercial success.

A third category of liquid laundry products, to which this invention belongs, is the emulsion. Detergent emulsions are typically aqueous and contain an isotropic phase (lye or nigre) and an anisotropic phase (neat or middle). Either phase may be continuous. There may be suspended within the emulsion, normally in the continuous phase, finely divided solid particulate material which may be an electrolyte of relatively low solubility such as a phosphate builder, or may be an inert, insoluble material.

To have practical utility, a detergent product in emulsion form must remain physically stable for considerable periods of time, e.e. the phases must not grossly separate to a large degree under normal conditions of storage. Some emulsion compositions require, to achieve satisfactory physical stability, addition of a stabilizing agent such as a resin polymer which is otherwise not useful in the composition. Other emulsion compositions are self-stabilizing: [the prior art has referred to them as autostabilized]; they need only to be properly formulated and processed and do not require the addition of a separate stabilizing agent. Emulsions of both kinds, i.e. those with and those without separate stabilizing agents, typically must be formulated within narrow ranges of composition: changing in a modest way the type surfactant or the builder, or using appreciably more or less of either, ordinarily is enough to cause instability.

The liquid laundry product of the present invention is in the form of an emulsion containing suspended, finely divided solid particles, and will sometimes be referred to hereinafter as an emulsion/suspension. This product form does not require a hydrotrope or a non-aqueous vehicle or solvent, either of which contributes heavily to cost without contributing to effectiveness in the washing process. It uses common raw materials which are widely available at relatively low cost, and it uses them without special purification. Its stabilizing agent is alkali metal sulfate, which in the form of sodium sulfate is already present in the least expensive form of the surfactant raw materials. It permits adjustment of amounts and ratios of the key ingredients over relatively broad ranges so that a formulator can adjust the composition to suit the technical and commercial requirements of himself and his customers. It is stable, both physically and chemically, during substantial periods of time under a wide variety of storage conditions commercially encountered.

All of the above are objects of the present invention which are achieved in the manner disclosed hereinbelow.

Prior Art

Among the numerous disclosures of single phase, optically clear, liquid laundry compositions the following may be mentioned as representative: U.S. Pat. No. 2,859,182 issued on Nov. 4, 1958 to Carroll; U.S. Pat. No. 2,878,186 issued on Mar. 10, 1959 to Krumrei; and U.S. Pat. No. 3,101,324 issued on Aug. 20, 1963 to Wixon.

U.S. Pat. No. 3,231,504 issued on Jan. 25, 1966 to Marion et al discloses alkyl ether sulfate/alkyl benzene sulfonate mixtures in a predominantly single phase built detergent liquid solubilized with hydrotrope. U.S. Pat. No. 3,574,125 issued on Apr. 6, 1971 to von Paassen discloses alkyl ether sulfate as the sole surfactant in an unbuilt detergent liquid containing a plasticizer such as dibutyl phthalate as well as a conventional hydrotrope.

Typical references relating to liquid laundry compositions the principal components of which form a single phase, optically clear liquid but which have minor amounts of finely divided solid or liquid material suspended therein, are U.S. Pat. No. 2,994,665 issued on Aug. 1, 1961 to Reich et al and U.S. Pat. No. 3,393,154 issued on July 16, 1968 to Treitler. Treitler suggests using neutral salts, e.g. sodium sulfate, in light duty liquids which do not contain alkaline builders such as phosphates.

Unbuilt single phase, optically clear liquid laundry compositions are disclosed in U.S. Pat. No. 3,869,399 issued to Collins on Mar. 4, 1975. Other references to similar compositions are U.S. Pat. No. 3,528,925 issued to Chapuis on Sept. 15, 1970; British Pat. No. 986,049 issued to Imperial Chemical Industries on Mar. 17, 1965; and U.S. Pat. No. 2,875,153 issued to Dalton on Feb. 24, 1959.

Liquid laundry compositions in mull form are disclosed in U.S. Pat. No. 2,864,770 issued to McCune et al on Dec. 16, 1958 and U.S. Pat. No. 3,169,930 issued to Gedge on Feb. 16, 1965.

Representative disclosures of liquid laundry products in emulsion/suspension form are U.S. Pat. No. 2,920,045 issued to Hearn et al on Jan. 5, 1960; U.S. Pat. No. 3,039,971 issued to Cohen on June 19, 1962; U.S. Pat. No. 3,328,309 issued to Grifo et al on June 27, 1967; U.S. Pat. No. 3,346,503 issued to Huggins on Oct. 10, 1967; U.S. Pat. No. 3,351,557 issued to Almstead et al on Nov. 7, 1967; U.S. Pat. No. 3,509,059 issued to Renold on Apr. 28, 1970; U.S. Pat. No. 3,574,122 issued to Payne et al on Apr. 6, 1971; U.S. Pat. No. 3,629,125 issued to Payne et al on Dec. 21, 1971; and Canadian Pat. No. 917,031 issued to Monroe et al on Dec. 19, 1972.

U.S. Pat. No. 3,501,409 issued on Mar. 17, 1970 to Matson et al discloses the use of low molecular weight alkyl ether sulfates as hydrotropes for increasing the solubility of alkyl benzene sulfonate in light- or heavy-duty liquid detergent compositions. The latter were formulated with a potassium polyphosphate as builder. Sodium sulfate was said to enhance detergency but was not an essential component.

U.S. Pat. No. 3,235,505 issued on Feb. 15, 1966 to Tuvell discloses a heavy duty detergent product in which alkyl ether sulfate may be the surfactant, which product is stabilized in emulsion/suspension form by a particular polymeric substance.

Disclosures of detergent liquid emulsion/suspension products in the form of abrasive cleaners are U.S. Pat. No. 3,210,285 issued to Gangwich on Oct. 5, 1965 and U.S. Pat. No. 3,813,349 issued to Wolfson on May 28, 1974. Gangwich used NaCl at levels of 0.25 to 2.5% to stabilize the composition against physical and chemical deterioration upon aging, and found similar though less effective benefits from other salts including $Na_2SO_4$.

A liquid laundry emulsion known to have been sold commercially has the approximate composition 14.4% branched chain alkyl benzene sulfonate; 1.8% coconut monoethanol amide; 18.5% sodium triphosphate; 1.6% silicate solids having a weight ratio of $SiO_2$ to $Na_2O$ of 2.0:1; 1% sodium sulfate; 0.2% phosphate ester stabilizing agent; minor amounts of carboxymethyl cellulose, optical brightener, formaldehyde and perfume; and the balance water. Low salt ABS paste as described hereinafter was required in this emulsion/suspension to achieve satisfactory physical stability, even though a phosphate ester stabilizing agent was incorporated.

SUMMARY

The liquid detergent compositions of this invention are in the form of emulsions containing finely divided solids suspended therein. They comprise 4 essential components:

a. surfactant in an amount from about 7% to about 25% by weight of the composition, said surfactant consisting of:
   i. Surfactant A selected from the group consisting of sodium alkyl sulfate $ROSO_3Na$ and sodium alkyl ether sulfate $R(OC_2H_4)_n\ OSO_3\ Na$, where R is an alkyl chain having from about 12 to about 20 carbon atoms and where n has an average value from about 1 to about 12, or mixtures thereof; and
   ii. Surfactant B consisting of sodium alkyl benzene sulfonate $R'\phi SO_3\ Na$ where R' is a branched alkyl chain having from about 9 to about 15 carbon atoms;

wherein the amount of Surfactant A is between about 3% and about 25% by weight of the composition;

b. inorganic phosphate builder in an amount from about 6% to about 25% by weight of the composition, said builder being selected from the group consisting of sodium orthophosphate, sodium pyrophosphate, and sodium tripolyphosphate;

c. alkali metal sulfate in an amount from about 3% to about 20% by weight of the composition as stabilizing electrolyte; and d. water in an amount from about 40% to about 75% of the composition.

Certain additional components may be included in the compositions of this invention in the proportions hereinafter described.

DETAILS OF THE INVENTION

Components

The compositions of the present invention contain surfactant. Essential to the invention is Surfactant A as will be described hereinafter in detail. Preferred are certain hereinafter described mixtures of Surfactant A with Surfactant B as defined below.

Surfactant A is sodium alkyl sulfate having the formula $R\ O\ SO_3Na$, or alkyl ether sulfate having the formula $R(O\ C_2H_4)_n\ O\ SO_3Na$, where R is an alkyl chain having from about 12 to about 20 carbon atoms and where n has an average value from 1 to about 12, or mixtures thereof.

A brief designation of these two compounds, respectively, is $C_{12\text{-}20}$-AS and $C_{12\text{-}20}$-$AE_{1\text{-}12}S$. In fact a still briefer designation, which emphasizes the close relationship between these compounds, is $C_{12\text{-}20}$-$AE_{0\text{-}12}S$.

Alkyl sulfates made by sulfating and neutralizing long-chain alcohols, have been well-known detergents for many years. At one time the alcohol base was derived from natural sources, such as coconut oil and tallow. More recently synthetic alcohols have become available by the Ziegler ethylene buildup process and by the Oxo process, the latter producing alkyl chains having a mixture of odd and even numbers of carbon atoms, in contrast to the first two processes mentioned which produce alkyl chains having only an even number of carbon atoms. Alcohol derived from all three sources may be used to produce alkyl sulfate for the compositions of the present invention.

The sulfated and neutralized ethoxylate detergents of the invention are also well known. Their preparation and properties are described, for example, in British Pat. No. 791,704 (Mar. 12, 1958); British Pat. No. 797,119 (June 25, 1958); U.S. Pat. No. 3,179,599 to Eaton et al. (Apr. 20, 1965); The Journal of the American Oil Chemists Society, 36, pp. 241–244 (June 1959); The Journal of the American Oil Chemists Society, 37, pp. 427–430 (Sept. 1960); and The Journal of the American Oil Chemists Society, 45, pp. 738–741 (November 1968).

It will be appreciated that the alkyl ether sulfate component comprises a mixture of water-soluble salts. This mixture comprises a distribution of alkyl ether sulfate detergent molecules of varying ethylene oxide content. When a given number, for example 3, moles of ethylene oxide are reacted with 1 mole of a high molecular weight alcohol, the resulting ethoxylated alcohol reaction product is comprised of a mixture of ether molecules having varying numbers of ethylene oxide groups. Generally, the reaction product will contain a mixture of unethoxylated alcohol admixed with alkyl ether compounds containing a variable number of ethylene oxide groups extending from alkyl mono(ethylene glycol) ether to an alkyl poly-(ethylene glycol) ether wherein the number of ethylene oxide groups is equal to or greater than about twice the number of moles of ethylene oxide reacted with the high molecular alcohol.

The designation hereinafter of $n$ as being, for example, 5 or 12 refers, respectively, to the alkyl ether sulfate detergent product which is the result of sulfation and neutralization in a known manner of an ethoxylated condensate derived from reaction of 5 or 12 moles, respectively, of ethylene oxide per mole of high molecular weight alcohol. The designation $n$ therefore refers to an average value, and the designation $AE_nS$ therefore refers to a mixture of species. It is well known that base- and acid-catalyzed ethoxylation result in different distributions of $n$, and both are encompassed by the compositions of the instant invention.

Alcohol derived from natural sources or from the Ziegler or Oxo synthesis may be used to produce the alkyl ether sulfate of this invention.

Preferred forms of Surfactant A are alkyl sulfate and alkyl ether sulfate where R is an alkyl chain having from about 14 to about 16 carbon atoms and where $n$ averages from 1 to 6; i.e. $Na\text{-}C_{14\text{-}16}AS$ and $Na\text{-}C_{14\text{-}16}AE_{1\text{-}6}S$ respectively, or in alternative notation $Na\text{-}C_{14\text{-}16}AE_{0\text{-}6}S$. Especially preferred is alkyl ether sulfate where R is an alkyl chain having from about 14 to about 16 carbon atoms and where $n$ averages about 1; i.e. $Na\text{-}C_{14\text{-}16}AE_1S$.

Surfactant B is branched chain sodium alkyl benzene sulfonate containing from about 9 to about 15 carbon atoms in the alkyl chain. This has the formula $R'\phi\lambda SO_3Na$ where R' is about 9–15. A brief designation of this compound is $Na\text{-}C_{9\text{-}15}ABS$. Preferred is branched chain sodium alkyl benzene sulfonate where R' is between about 11 and about 13, and especially preferred is this compound where the average number of carbon atoms in the alkyl chain is about 12.

The amounts of Surfactant A and Surfactant B that are a part of the compositions of this invention are not independent of one another but are interrelated.

One of the principal criteria of operability is physical stability. By physical stability of the liquid compositions of this invention is meant herein the characteristic of remaining acceptably homogeneous and fluid over reasonable periods of time under a variety of storage conditions such as is likely to be encountered in the trade. Of course it will be appreciated that the temperatures likely to be encountered in Honolulu, Hawaii; Washington, D.C.; and Fairbanks, Alaska differ greatly from one another, so the requirements for commercial usefulness necessarily vary with the commercial purpose.

By "homogeneous" is meant herein, not a single phase system or optical clarity, but a multi-phase system in which the discontinuities are relatively small. A more detailed description of the physical properties of the compositions of this invention is given infra.

By "acceptably" homogeneous is meant herein a condition short of absolute perfection that is acceptable to consumers. Certain heavy duty laundry liquid detergent products successfully marketed commercially have shown separation of 1–3% by volume of a clear liquid phase from the otherwise homogeneous product during a period of about 3 months' storage at 90° F. Other market products have separated small amounts of precipitate, crystalline or flocculent. Ordinarily gentle shaking causes such products to once again appear visually homogeneous for a time ranging from a few hours to a few days.

In general, the compositions of this invention which are preferred for reasons of stability are those which remain homogeneous and do not separate appreciably during normal self storage, while those which are not preferred for this reason (but many of course be preferred for other reasons, such as cost, performance, etc.) are, after comparable storage, within the foregoing broader definition of acceptably homogeneous.

Another criterion is viscosity. It is intended that the compositions of this invention are fluids. For commercial reasons it is preferred that the compositions are pourable, as from a bottle, although those that have the consistency of an ointment and can be squeezed as from a tube are also included.

Still other criteria for preferred compositions are cleaning and sudsing characteristics and the cost and availability of raw materials. These variables are within the control of the skilled formulator in the usual way.

In the discussion of surfactant amounts that follows, it will be assumed that all remarks apply to compositions which contain amounts of sodium phosphate builder and alkali metal sulfate stabilizer that are within the scope of this invention as hereinafter defined.

Surfactant in amounts greater than about 7% by weight is needed to produce stable compositions. Amounts greater than about 25% by weight produce excessively viscous compositions. The operable range of compositions containing Surfactant A as the only surfactant accordingly lies between about 7% and about 25% as illustrated by line AB on FIG. 1.

Surfactant B, when used alone, does not produce stable compositions. However when at least about 3% of Surfactant A is added to amounts of Surfactant B ranging from about 4% to about 22%, stable compositions result. Below about 4% stability suffers, and above about 22% viscosity is excessive.

Designating the amounts of Surfactant A and Surfactant B as $\alpha$ and $\beta$, respectively, these criteria can be expressed mathematically by a series of inequalities:

$$[\alpha+\beta] \leq 25$$

which is expressed by the line BC on FIG. 1;

$$7 \leq [\alpha+\beta]$$

which is expressed by the line DA on FIG. 1; and $$3 \leq \alpha$$

which is expressed by the line EF on FIG. 1. A composition of this invention therefore simultaneously satisfies the inequalities:

$$7 \leq [\alpha+\beta] \leq 25 \quad (1)$$

and $$3 \leq \alpha \quad (2)$$

The operable area is therefore illustrated by the area ABGHA on FIG. 1.

Because equation (1) above necessarily limits $\alpha$ to a maximum of 25, equation (2) above can alternatively be expressed as:

$$3 \leq \alpha \leq 25 \quad (2')$$

It is preferred to use at least about 8% total surfactant for reasons of enhanced stability; to use at least about 3% Surfactant B for reasons of enhanced stability, lower viscosity and lower cost; and to use no more than about 18% total surfactant for reasons of lower viscosity; while maintaining at least 3% Surfactant A as before for reasons of stability. Accordingly the preferred area simultaneously satisfies the following mathematical inequalities:

$$8 \leq [\alpha+\beta] \leq 18 \quad (3)$$

$$3 \leq \alpha \quad (4)$$

and $$3 \leq \beta \quad (5)$$

which is illustrated by the area JKLMJ on FIG. 1.

As explained in relation to equation (2), equations (4) and (5) can alternatively be expressed as $$3 \leq \alpha \leq 15 \quad (4')$$

and $$3 \leq \beta \leq 15 \quad (5')$$

Especially preferred for the same reasons stated above are compositions wherein the total surfactant usage is no greater than about 15% and the usages of Surfactants A and B individually are each at least about 5%. Mathematically:

$$10 \leq [\alpha+\beta] \leq 15 \quad (6)$$

$$5 \leq \alpha \quad (7)$$

and $$5 \leq \beta \quad (8)$$

which is illustrated by the area NPQN on FIG. 1.

Alternative expressions for equations (7) and (8) are:

$$5 \leq \alpha \leq 10 \quad (7')$$

and $$5 \leq \beta \leq 10 \quad (8')$$

Another component of the present invention is inorganic phosphate builder. This component is in the form of sodium salts, and more specifically may be sodium orthophosphate, sodium pyrophosphate, sodium tripolyphosphate, which is sometimes referred to herein as sodium triphosphate, or mixtures thereof.

In the form of fully neutralized salts, the above phosphates have the formulas $Na_3PO_3$, $Na_4P_2O_7$, and $Na_5P_3O_{10}$, respectively.

Acid forms of the sodium phosphate species described above are also usable in the compositions of this invention. For example $Na_2HPO_4$ and $Na_2H_2P_2O_7$ are commercially available and may be used, subject to the fact that they reduce the pH of the detergent composition as compared with that which would result from the use of fully neutralized forms [pH is discussed more fully hereinafter].

The amount of phosphate builder used in the emulsion/dispersion compositions of the present invention is between about 6% and about 25% by weight of the composition. Less than about 6% is insufficient for the emulsion/dispersion to perform satisfactorily as a detergent composition, while more than about 25% contributes excessively to viscosity. Preferred amounts of phosphate builder are between about 8% and about 20%. Highly preferred amounts are between about 10% and about 18%, and especially highly preferred amounts are between about 14% and about 16% by weight of the composition.

According to the prior art, the solubilities in water of the abovementioned fully neutralized sodium phosphate species are no greater than about 10 parts at 70° F. and about 27 parts at 100° F., where these parts are parts of anhydrous salt per 100 parts of water, regardless of whether the crystalline phase in equilibrium with the dissolved species is anhydrous or hydrated. Phosphates having solubilities substantially greater than these values cannot be used in major proportion in the compositions of this invention, because they tend to dissolve in the emulsion rather than become suspended in it. Highly soluble sodium phosphates such as sodium metaphosphate and glassy phosphates can however be used in minor proportion, up to about 1–3% by weight of the compositions. This limitation applies also to the very soluble potassium phosphates. It does not apply to the sodium acid phosphates described above because they tend to be less soluble than their corresponding fully neutralized species.

Preferred phosphate species are tetra sodium pyrophosphate $Na_4P_3O_7$ and penta sodium tripolyphosphate $Na_5P_3O_{10}$. At ordinary storage temperatures, these species in equilibrium with water exist in the form of sodium pyrophosphate decahydrate and sodium tripolyphosphate hexahydrate, respectively. Sodium orthophosphate equilibrates with water at ordinary storage temperatures as the dodecahydrate.

Alkali metal sulfate is the stabilizing electrolyte for the compositions of this invention. Below about 3% alkali metal sulfate by weight of the composition, emulsions are not stable even though they contain Surfactant A, Surfactant B, phosphate builder and water in the amounts herein described. Amounts greater than about 20% by weight of the composition do not contribute additional stability, but do contribute to increased viscosity and increased cost.

Preferred amounts of alkali metal sulfate stabilizing agent are between about 5% and about 12% by weight of the composition. The amount required for stabilization tends to be more critical when the total amount of surfactant is near the lower end of its operating range. It is within the skill of the ordinary practitioner to formulate stable compositions according to these guidelines.

Sodium sulfate is the preferred alkali metal sulfate, though potassium sulfate is also an effective stabilizing agent.

Alkali metal salts other than sulfates do not exert this stabilizing effect. Salts having such disparate solubilities, charge densities and ionic strengths as sodium chloride, sodium carbonate, sodium hydroxide, tetrapotassium pyrophosphate and the various sodium phosphates described hereinbefore do not act effectively as stabilizing agents.

Alkali metal sulfate is not only an effective stabilizing agent but it is also readily available. It is most commonly present in the form of sodium sulfate as a byproduct of the sulf(on)ation reactions used in the synthesis of Surfactant A and Surfactant B using oleum as sulfating agent. Ordinary surfactant paste prepared in this way can be used without purification. Alternatively, if surfactant paste is more conveniently available that has been made by sulfation with sulfur trioxide, $SO_3$, and is low in sodium sulfate content, crystalline sodium or potassium sulfate can be added and mixed into the paste in amounts needed to bring the alkali metal sulfate usage within the limits herein specified for the compositions of this invention.

Water is the vehicle of the emulsion/dispersion which constitutes the present invention. It dissolves the alkali metal sulfate suspending agent, interacts with the surfactants to form an anisotropic liquid crystalline phase, and forms a phosphate hydrate crystal of relatively low solubility.

Amounts of water greater than about 75% by weight of the composition do not form emulsion/dispersions having sufficient yield point or viscosity for stability, while amounts below about 40% are excessively viscous. Amounts of water between about 50% to about 70% are preferred.

The liquid laundry compositions of this invention may contain various optional ingredients. Among these may be mentioned the use of minor amounts (typically less than 1% each, of colorant, perfume, bactericide, optical brightener and tarnish inhibitor. These minor ingredients dissolve in one or more of the liquid phases present, or go to the interface between them, and in either event do not significantly affect stability.

Solvents such as alcohols and glycols are not needed in the practice of the present invention, and are in fact not useful in appreciable amounts because they tend to reduce rather than enhance physical stability. However they can be tolerated in minor amounts, for example if present as an impurity in one of the major components of the composition or if used to solubilize a minor component thereof. Urea can be used as a viscosity modified in amounts up to about 5%.

Supplementary surfactants may be used, in addition to those defined as Surfactant A and Surfactant B, at relatively low levels (up to about 1–3%) in the emulsion/dispersion of this invention. Supplementary surfactants may be other anionic, zwitterionic, ampholytic, nonionic, or semi-polar surfactants, their use being selected for reasons inter alia of cost and laundry performance characteristics such as suds boosters, suds suppressors, or cleaning enhacers. Hydrotropes such as sodium toluene sulfonate may be used at similar levels.

Anti-redeposition agents such as the well known sodium carboxymethyl cellulose and polyethylene glycols may be used; when this is done care should be used to obtain thorough dispersion in the liquid to avoid the formation of jellied masses.

When pyrophosphate is used as builder, glassy phosphates in amounts of 1–3% by weight of the composition are useful whiteness maintenance additives. In particular, glassy phosphates having the formula $$(M_2O)_x(P_2O_5)_y$$

wherein M is an alkali metal, preferably sodium; $y$ having a value of from about 5 to 50, preferably 7 to 25, with the ratio of $y$:$x$ from about 1:1 to about 1:1.5 are useful in the present invention for whiteness maintenance.

Preferred values of $y$ above are such that there are 10, 14, and 21, most preferably 14 and 21 phosphor atoms in the compound. A more preferred range of glassy phosphate is from about 0.5% to about 2.5% by weight, most preferably from about 1.0% to about 2% by weight of the finished product. Alternatively the formula of the glassy phosphates can be expressed as $M_{2y+2}P_{2y}O_{6y+1}$ wherein M is an alkali metal and $y$ varies from 7 to 12.

Another useful whiteness maintenance additive used at comparable levels is a water soluble copolymer of a vinyl compound of the formula RCH=CHR, wherein one R represents a hydrogen atom and the other R represents an $-OCH_3$ radical or a hydrogen atom, and maleic anhydride, or water soluble alkali metal or ammonium salt of said copolymer. Maleic anhydride-vinyl ether is a good example of this copolymer.

The natural pH of the compositions of this invention containing only the essential components and made with $Na_4P_2O_7$ or $Na_5P_3O_{10}$ is about 9–11. It is higher if a more alkaline phosphate like $Na_3PO_4$ is used, and lower if acid phosphates like $Na_2H_2P_2O_7$ are used. The natural pH may be modified not only by switching phosphates but also by adding appropriate amounts of acid or base in the usual way. Dilute solutions are recommended for this purpose to avoid adversely affecting the stability of the emulsion/dispersion by excessive localized ionic charges.

It is also possible to add buffering capacity to these emulsion/suspensions by adding a source of reserve alkalinity. Sodium carbonate is a good buffering agent for this purpose, and usage up to about 3–6% by weight is suggested. Sodium silicate in similar amounts on a solids basis also serves this purpose.

In the foregoing disclosure, sodium salts have been specified for the phosphate and surfactant which are present in the form of ordinary crystals and liquid crystals, respectively. Only minor amounts of the more soluble potassium salts of phosphate and surfactant can be tolerated. In contrast to this, sulfate which is present in dissolved form can be any alkali metal salt.

Optional ingredients which may be added in appreciable amounts (from about 1% to about 10%) to the compositions of this invention are preferably in a form of relatively low solubility, so they, like the phosphate crystals, will be in suspended rather than dissolved form. Such materials include aluminosilicates which may be useful as cobuilders with phosphate.

One such aluminosilicate which is useful in the compositions of the invention is an amorphous water-insoluble hydrated compound of the formula $Na_x(xAlO_2 \cdot ySiO_2)$, wherein $x$ is a number from 1 to 1.2 and $y$ is 1, said amorphous compound being further characterized by a $Mg^{++}$ exchange capacity of from about 50 mg. eq. $CaCO_3$/g. to about 150 mg. eq. $CaCO_3$/g. and a particle diameter of from about 0.01 microns to about 5 microns. This ion exchange builder is more fully described in the patent application of Gedge et al serial number 1505–74 filed on July 16, 1974 and laid open to the public on Jan. 16, 1975 by the Republic of Eire and herein incorporated by reference; corresponding applications were also filed in West Germany on July 12, 1974 as Ser. No. P24-33485 and in Great Britain on July 15, 1974 as Ser. No. 31238-74.

A second water-insoluble synthetic aluminosilicate ion exchange material useful herein has the formula $Na_z[AlO_2)_z.(SiO_2)_y]xH_2O$, wherein $z$ and $y$ are integers of at least 6; the molar ratio of $z$ to $y$ is in the range from 1.0 to about 0.5, and $x$ is an integer from about 15 to about 264; said aluminosilicate ion exchange material having a particle size diameter from about 0.1 micron to about 100 microns; a calcium ion exchange capacity of at least about 200 mg. eq.g; and a calcium ion exchange rate of at least about 2 grains/gallon/minute/gram. This ion exchange builder is more fully described in Belgian Pat. No. 814,874 issued on Nov. 12, 1974 to Corkill et al, herein incorporated by reference.

Processing

Special processing of the compositions of the present invention is not needed to achieve satisfactory stability. An ordinary turbine mixer has proven satisfactory to obtain a stable emulsion/dispersion. High shear mixing, as by an Eppenbach mixer or a colloid mill, is not required.

However, it is preferred to take precautions to remove air and to ensure that all portions of the emulsion/dispersion pass through the mixing zone sufficiently, for example, to avoid the presence of lumps of dry ingredients. This result can be achieved by multiple passes through an ordinary turbine or propeller mixer or by using a flow-through device such that every part of the composition must flow through the mixing zone, as for example a colloid mill, homogenizing valve, Versator [trademark — Cornell Machine Co., (USA)] spinning bowl deaerator, or centrifugal pump.

Certain phosphate builder salts have a relatively large variation of solubility with temperature; therefore it is preferred to prepare the emulsion/dispersion at a temperature similar to that of the expected storage. For similar reasons, it is preferred to minimize the temperature fluctuations that occur during storage. These precautions are less necessary for compositions containing sodium triphosphate builder, as explained in greater detail infra. Thus the preferred mixing temperatures for emulsions containing sodium tripolyphosphate are between about 70° F. and about 130° F., while the preferred mixing temperatures for emulsions containing other phosphate builders are between about 70° F. and about 110° F. Prior art compositions in emulsion/suspension form are often mixed without special control over temperature, and using raw materials at their normal storage temperatures are most conveniently mixed at about 120°–130° F.

Physical Characteristics

The compositions of the present invention are viscous liquids which are thixotropic and have the characteristics of a Bingham plastic. They are principally composed of three phases: an isotropic phase, an anisotropic liquid crystalline phase, and a solid crystalline phase.

The isotropic phase is comprised of water with certain other components completely dissolved therein: most or all of the sodium sulfate, some of the surfactant(s), and some of the phosphate builder.

The anisotropic liquid crystalline phase is believed to be a neat phase containing predominantly surfactant(s) and water with minor amounts of soluble electrolyte. In microscopic observations at 450 power a few bright neat phase droplets are typically visible in a background which appears to consist of a continuous isotropic phase containing droplets of neat dispersed so finely they are beyond the resolving power of the microscope (i.e. smaller than about 0.6 microns).

The solid crystalline phase consists principally of the sodium phosphate builder salt in the form that is in equilibrium with a saturated solution at the ambient temperature. For most phosphate builders and most ordinary temperatures this is a hydrate, for example $Na_3PO_4 \cdot 12\ H_2O$ for trisodium orthophosphate, $Na_4P_2O_7 \cdot 10H_2O$ for tetrasodium pyrophosphate; and $Na_5P_3O_{10} \cdot 6\ H_2O$ for pentasodium tripolyphosphate. Similarly hydrated forms are also known for many of the partially neutralized, i.e. acid, forms of these sodium phosphate builder salts, for example $Na_3HP_2O_7 \cdot 9H_2O$.

The phosphate crystals in the liquid compositions of this invention typically have a major dimension between about 1 and about 100 microns, as determined by microscopic examination. They are present in the continuous liquid phase and remain suspended therein because of the non-Newtonian characteristics of the compositions.

Time of discharge of typical compositions within the composition boundaries NPQN on FIG. 1, in a Zahn viscometer at 90° F., using a no. 5 cup, varies from about 60–120 seconds when the fluid has been at rest to as little as 10–40 seconds after it has been agitated for a period of time. These numbers correspond to apparent viscosities varying from about 1800–3600 centipoises to about 300 to 1200 centipoises. The original higher viscosity is fully recovered upon standing. Compositions outside the NPQN boundaries, especially in the directions of greater Surfactant A or greater total surfactant, have very much greater viscosities.

The compositions of the present invention tend to exhibit greater viscosity when any portion of the water is replaced by any other component. This is true when additional surfactant of a given type replaces water, when additional phosphate builder replaces water, and when additional metal alkali sulfate replaces water. However, these increases are not the same for all components, and not the same for any one component in compositions that differ in other respects. These are normal phenomena for emulsion/dispersion liquid detergent compositions, and can be easily dealt with by one skilled in the art.

Such a skilled person will appreciate therefore that compositions simultaneously containing amounts of surfactant, phosphate builder and metal alkali sulfate which are near their respective maxima as described herein will be extremely viscous and will not be preferred for that reason.

The liquid detergents of this invention do not disperse instantaneously into the water of a laundry bath, but take some time to do so, from as little as about 2 minutes up to as much as 20 minutes, depending upon their composition and upon conditions such as temperature and agitation. The Wolfson reference cited hereinbefore took similar facts to mean that in his emulsion the neat phase was continuous, but this is not believed to be true for the compositions of the present invention.

The compositions within the scope of the invention as herein defined are stable as hereinbefore defined over a variety of storage conditions for lengths of time appropriate to commercial practice. That is, they appear to be and to remain acceptably homogeneous, although of course they comprise an intimate mixture of three different phases as hereinbefore described.

Compositions outside the scope of the invention may exhibit various kinds of instability. This instability is ordinarily of a physical nature, pertaining to the size of the discontinuities of the phases, rather than a chemical instability of any of the components individually.

One kind of physical instability is caused by a breakdown of the emulsion. If circumstances are such that droplets of discontinuous liquid phase coalesce together, after a time the droplets become large enough to form a separate, gross, visually detectable layer.

Another kind of instability is creaming. This results when the droplets of discontinuous phase migrate under the influence of gravity to form a richer, more concentrated emulsion layer and leave behind a clear isotropic layer. The discontinuous phase can migrate either upward or downward, depending on the exact composition, because if creaming takes place its direction is determined by the relative densities of the two layers: the rich emulsion layer contains dispersed builder while the anisotropic layer contains dissolved electrolyte. This is often seen in compositions outside the scope of this invention where a sample, after shelf aging, may have 20–30% by volume of isotropic liquid at the top.

A third kind of instability is a gross separation of the crystalline phase. Ordinarily this happens only when the phosphate builder crystals or possibly sulfate crystals grow over a period of time; this happens when the electrolyte first dissolves in the isotropic phase and then precipitates therefrom. This can be a particular problem in a composition that has separated a discrete isotropic layer, because crystals at the interface of this layer can grow unimpeded by the more viscous emulsion phase.

Sodium tripolyphosphate is a preferred builder salt from this point of view because the solubility of the sodium tripolyphosphate hexahydrate crystals changes very little over the entire range of practical storage conditions (from a low of 15 to a high of 16 parts anhydrous salt per 100 parts water between 32° and 120° F.) Other phosphate salts, although they do not have the especially favorable non-varying solubility of sodium triphosphate, are nevertheless satisfactorily stable when prepared according to the teachings of the present disclosure.

Physical stability of the compositions of this invention can be measured in two ways. The first, centrifugation, is a measure of stability of the composition in the form in which it exists at any one point in time and can be used to predict future stability. A typical measurement is to centrifuge about 50 gms. of product for 20 min. at 30,000 times the force of gravity (i.e. at 30,000G's). If the sample separates into three or more layers, typically an anisotropic surfactant phase, an isotropic lye or nigre phase, and solid crystals, it will probably exhibit liquid/liquid separation within a few months. A small amount of isotropic phase separation (e.g. 1–3% by volume) is generally acceptable but large amounts (e.g. 5–30% by volume) are unacceptable. Generally the more isotropic phase separation that occurs, the faster and greater the separation will be during shelf storage. If the samples separate into only two layers, typically anisotropic/isotropic emulsion and solid crystals, the product will not separate out either liquid phase or large crystals after 3–6 months' storage.

EXAMPLES

Example 1

To a 2-liter stainless steel beaker with an inside diameter of 6½ inches was added 541.6 grams of a synthetic detergent paste, 178.4 grams of water, 6.0 grams of 98% $H_2SO_4$ for pH adjustment, and 0.22 grams of a 37% formaldehyde solution. The synthetic detergent paste was made by sulfation with 20% oleum and neutralization with NaOH, and contained 12.9% branched chain alkyl benzene having 12 carbon atoms in the alkyl chain, 9.2% alkyl ether sulfate having 14–15 carbon atoms in the alkyl chain and ethoxylated with an average of 1.0 mols of ethylene oxide per mol of fatty alcohol, 15.1% $Na_2SO_4$, and 16.9% $H_2O$. Temperature of the paste was about 80° F. and the water about 70° F.

Agitation was provided by a Lightnin' [Trade Mark — Mixing Equipment Company] Model V-7 laboratory mixer fitted with a 6-bladed, 3-inch diameter turbine. Impeller speed was about 1800 r.p.m. and the corresponding top speed of the blades was about 1400 feet per minute.

Agitation continued unchanged for about 2–3 minutes after the ingredients specified above were added to the beaker, following which 140.0 grams of anhydrous pentasodium tripolyphosphate were added and agitation continued for an additional 2–3 minutes approximately. Temperature of the batch at this point was about 125° F.

Carboxy methyl cellulose in the amount of 2.5 grams as antiredeposition agent and $Na_2CO_3$ in the amount of 25.0 grams as a buffer and source of alkalinity were added, and agitation continued about 2–3 minutes.

A water slurry of minor ingredients was next added: 100.1 grams of water containing 0.6 grams of optical brightener and colorant. Agitation continued about 2–3 minutes.

Five grams of coconut fatty alcohol were added as a suds control agent, following which agitation continued about 2–3 minutes.

Perfume in the amount of 0.7 grams was added and agitation continued an additional 10 minutes, following which the composition was complete and agitation was stopped. Batch temperature was between about 120° F and 130° F.

The composition was a slurry, appearing visually to be nearly homogeneous but actually consisting of 3 separate phases. The composition was passed through a Fryma [Trade Mark — Fryma-Maschinen AG (Switzerland)] spinning basket deaerator to remove a few lumps of sodium triphosphate and sodium carbonate and to remove air bubbles.

The composition of Example 1 had good physical stability as measured by both centrifuge and storage tests. A sample was centrifuged at 30,000 G. for 20 minutes. The sample separated into two layers, a turbid liquid emulsion layer (about 80% by volume) and a solid bottom layer (about 20% by volume). Samples were stored quiescent for 1½ months at 70°, 80°, and 90° F. No visible liquid or solids separation occurred in these samples. After one week storage, the viscosity of this product was greater than 60 seconds (Zahn cup No. 5). Upon rapid stirring the viscosity fell to about 25 seconds.

Cleaning performance of the composition of Example 1 was good.

In tripolyphosphate containing compositions, 6–8% Surfactant B and 7–9% sodium sulfate are preferred.

Examples 2–5

Example 1 was repeated except for differences in types and amounts of the components as shown on Table I for Examples 2–5.

The centrifuge test described for Example 1 showed Examples 2–5 to separate a crystal layer and none to separate more than one liquid layer. The volumes of the separated crystal layers varied with the amount of phosphate in the composition; e.g. for Example 2 it was about 75% liquid emulsion/25% solid crystals.

In shelf tests, the compositions of Examples 2–5 remained essentially homogeneous for 4 months at 70°, 80°, and 90° F.

Cleaning performance of the compositions of Examples 2–5 is good.

Examples 6–8

Example 1 was repeated except for differences in types and amounts of the components as shown on Table I for Examples 6–8.

The centrifuge test described for Example 1 showed all samples to separate a crystal layer and none to separate more than one liquid layer.

Cleaning performance of the compositions of Examples 6–8 is good.

Example 7 was exactly repeated except that 2%, 6%, and 12% sodium sulfate were used, respectively, replacing water. In the centrifuge test the 6% and 12% $Na_2SO_4$ compositions were good; the 2% $Na_2SO_4$ composition was not..

Example 9

To a 2-liter stainless steel beaker with an inside diameter of 5.0 inches was added 225.2 grams of synthetic detergent paste X, 162.9 grams of synthetic detergent paste Y, 389.5 grams of a slurry premix containing 360.2 grams water, 0.178 grams of 37% formaldehyde solution, 7.1 grams of 70% active carboxy methyl cellulose, 10 grams of polyethylene glycol having a molecular weight of about 6000, 10 grams of sodium toluene sulfonate and 2 grams of brightener. After mixing for 2–5 minutes, 5 grams of coconut alcohol was added and then 54.4 grams of sodium sulfate and 10 grams of Glass H phosphate, all materials at ambient (78°–80° F) temperatures, and finally 150 grams of $Na_4P_2O_7$ were added slowly and allowed to mix 5–8 minutes until smooth, the temperature rising about 30° F. during the addition of the phosphate.

The synthetic detergent pastes were made by sulf(on-)ation with $SO_3$ and neutralization with NaOH. Paste X contained 44.4% branched chain $C_{12}$- alkyl benzene sulfonate, 54% water, 1.1% sulfate and approximately 0.5% unreacted material. Paste Y contained 30.7% $C_{14-15}AE_{1.0}S$, 67.1% water, 0.6% sulfate and 1.6% unreacted material.

In pyrophosphate containing compositions, 9–11% Surfactant B and 5–7% sodium sulfate are preferred.

Glass H is a glassy phosphate, commercially available from the FMC Corporation, which is a sodium salt containing 21 phosphorus atoms per molecule.

Agitation was provided by a Premier Dispersator with a 6-bladed, 3-inch diameter turbine at slow to medium speed. Three grams of perfume were added after deaeration in a Fryma (trademark) spinning basket deaerator to remove air bubbles.

The composition had good physical stability on storage testing with cycling temperatures. Cleaning performance was good.

Reference Examples R1–R3

Reference Example R1 is a commercially sold liquid laundry product in emulsion/suspension form. In 3 months' shelf storage at 90° F. it separates a second liquid phase in the amount of 1–3% by volume. Products of the same composition made in the laboratory show comparable stability.

Reference Examples R2 and R3 are the R1 compositions with minor changes: R2 contains 4% $Na_2SO_4$, while R3 contains no phosphate ester stabilizing agent. The compositions of Reference Examples R2 and R3 show a liquid separation of about 20% by volume in about 4 weeks.

The compositions of Reference Examples R1–R3 are given in Table I.

TABLE I

| EXAMPLE | 1 | 2 | 3 | 4 | 5 | 6 | 7 | 8 | 9 | R1 | R2 | R3 |
|---|---|---|---|---|---|---|---|---|---|---|---|---|
| COMPOSITION (Wt. %) | | | | | | | | | | | | |
| Alkyl ether sulfate[a] | 5 | 5 | 7.2 | 14.4 | 7.2 | 7.5 | 7.5 | 5 | 5 | — | — | — |
| Alkyl benzene sulfonate[b] | 7 | 5 | 7.2 | — | 7.2 | 10.5 | 10.5 | 7 | 10 | 14.4 | 14.4 | 14.4 |
| CN monoethanol amide | — | — | — | — | — | — | — | — | — | 1.8 | 1.8 | 1.8 |
| $Na_4P_2O_7$ | — | — | 9.3 | — | — | — | — | 9.3 | 15 | — | — | — |
| $Na_5P_3O_{10}$ | 14 | 18.5 | — | 18.5 | 18.5 | 21 | 14 | — | — | 18.5 | 18.5 | 18.5 |
| $Na_2SO_4$ | 8.3 | 8 | 9.6 | 9.6 | 9.6 | 8 | 4 | 8 | 6 | 1 | 4 | 1 |
| phosphate ester[c] | — | — | — | — | — | — | — | — | — | 0.2 | 0.2 | — |
| $Na_2CO_3$ | 2.5 | — | 1.1 | — | — | — | — | — | — | — | — | — |
| PEG 6000[d] | — | — | 1 | — | — | — | — | — | 1 | — | — | — |
| Ludox solids[e] | — | — | 1.6 | — | — | — | — | — | — | — | — | — |
| Silicate solids[f] | — | — | — | 1.6 | 1.6 | — | — | — | — | 1.6 | 1.6 | 1.6 |
| CMC[g] | 0.3 | 0.3 | — | 0.3 | 0.3 | — | — | — | 0.5 | 0.3 | 0.3 | 0.3 |
| Glass H[h] | — | — | — | — | — | 0.4 | — | — | 1 | — | — | — |
| Na Toluene Sulfonate | — | — | — | — | — | — | — | — | 1 | — | — | — |

TABLE I-continued

| EXAMPLE | 1 | 2 | 3 | 4 | 5 | 6 | 7 | 8 | 9 | R1 | R2 | R3 |
|---|---|---|---|---|---|---|---|---|---|---|---|---|
| Other minors | 0.7 | 0.7 | 0.7 | 0.7 | 0.7 | — | — | — | 1 | 0.2 | 0.2 | 0.2 |
| Water | 61.2 | 62.5 | 62.3 | 54.9 | 54.9 | 52.6 | 64 | 70.7 | 59.5 | 62 | 59 | 62.2 |

Examples 10–29

Compositions as shown on Table II are prepared by the process of Example 1. Each composition is an emulsion/suspension having physical stability that is acceptable in all respects. Detergency performance in the laundry is good for each composition.

TABLE II

| EXAMPLE | 10 | 11 | 12 | 13 | 14 | 15 | 16 | 17 | 18 | 19 | 20 | 21 | 22 | 23 | 24 | 25 | 26 | 27 |
|---|---|---|---|---|---|---|---|---|---|---|---|---|---|---|---|---|---|---|
| COMPOSITION (Wt. %) | | | | | | | | | | | | | | | | | | |
| Alkyl sulfate | — | — | — | — | — | — | 10a | 4b | — | — | — | — | — | — | — | — | — | — |
| Alkyl ether sulfate | 7d | 15c | 24j | 4f | 20i | 3h | — | 5g | 8i | 16e | 4e | 10f | 3g | 5c | 5c | 5c | 10c | 5c |
| Alkyl benzene sulfonate | — | — | — | 3k | 3k | 6m | 5m | 8m | 12m | 8m | 15m | 15n | 20m | 10m | 10m | 10m | 14m | 5m |
| $Na_3PO_4$ | — | — | 6 | — | — | 7 | — | 4 | 8 | — | — | — | 17 | — | — | — | — | — |
| $Na_4P_2O_7$ | — | 9 | — | — | — | — | — | 4 | — | 10 | 16 | — | — | 15 | 15 | 15 | 15 | 8 |
| $Na_5P_3O_{10}$ | 20 | — | — | 25 | 6 | 8 | 14 | 5 | 7 | — | — | 15 | — | — | — | — | — | — |
| $Na_2SO_4$ | 15 | 10 | 9 | — | 7 | 8 | 8 | 6 | 4 | 5 | 4 | 3 | 4 | 6 | 5 | 4 | 16 | 8 |
| $K_2SO_4$ | — | — | — | 6 | — | — | — | — | — | — | — | — | 4 | — | — | — | — | — |
| Aluminosilicate[p] | — | — | — | — | — | — | — | — | — | — | — | — | — | — | 5 | — | — | — |
| Copolymer[q] | — | — | — | — | — | — | — | — | — | — | — | — | — | — | — | 1 | — | — |
| $H_2O$ | 58 | 66 | 61 | 62 | 64 | 68 | 63 | 64 | 61 | 61 | 61 | 57 | 52 | 64 | 60 | 65 | 45 | 74 |

Key to Table II
[a]$C_{12-14}$ AS (Ziegler)
[b]Tallow AS
[c]Coconut $AE_1S$
[d]$C_{16-18}$ $AE_1S$ (Ziegler)
[e]$C_{14-15}$ $AE_3S$ (Oxo)
[f]$C_{14-18}$ $AE_3S$ (Ziegler)
[g]$C_{11-15}$ $AE_6S$ (oxo)
[h]$C_{18-20}$ $AE_6S$ (Ziegler)
[i]$C_{14}$-$AE_{10}S$ (Ziegler)
[j]$C_{10-11}$ $AE_{12}S$ (Oxo)
[k]$C_{11-12}$ ABS
[m]$C_{12-13}$ ABS
[n]$C_{13-15}$ ABS
[p]Aluminosilicate
[q]Maleic anhydride-vinyl ether copolymer

What is claimed is:

1. A liquid detergent composition which comprises:

a. surfactant in an amount from about 7% to about 25% by weight of the composition, said surfactant consisting of:

i. Surfactant A selected from the group consisting of sodium alkyl sulfate $ROSO_3Na$ and sodium alkyl ether sulfate $R(OC_2H_4)_n OSO_3Na$, where R is an alkyl chain having from about 12 to about 20 carbon atoms and where $n$ has an average value from about 1 to about 12, or mixtures thereof; and ii. Surfactant B consisting of sodium alkyl benzene sulfonate $R'\phi SO_3Na$ where R' is a branched alkyl chain having from about 9 to about 15 carbon atoms;

wherein the amount of Surfactant A is between about 3% and about 25% by weight of the composition;

b. inorganic phosphate builder in an amount from about 6% to about 25% by weight of the composition, said builder being selected from the group consisting of sodium orthophosphate, sodium pyrophosphate, and sodium tripolyphosphate;

c. alkali metal sulfate in an amount from about 3% to about 20% by weight of the composition as stabilizing electrolyte; and d. water in an amount from about 40% to about 75% of the composition.

2. The liquid detergent composition of claim 1 wherein the surfactant is present in an amount from about 8% to about 18% by weight of the composition, and wherein the amounts of Surfactant A and Surfactant B are each between about 3% and about 22% by weight of the composition.

3. The liquid detergent composition of claim 2 wherein the surfactant is present in an amount from about 10% to about 15% by weight of the composition, and wherein the amounts of Surfactant A and Surfactant B are each between about 5% and about 10% by weight of the composition.

4. The liquid detergent composition of claim 1 wherein the alkali metal sulfate is sodium sulfate and wherein the inorganic phosphate builder is sodium pyrophosphate.

5. The liquid detergent composition of claim 1 wherein the alkali metal sulfate is sodium sulfate and wherein the inorganic phosphate builder is sodium tripolyphosphate.

6. The liquid detergent composition of claim 2 wherein the alkali metal sulfate is sodium sulfate and wherein the inorganic phosphate builder is sodium pyrophosphate.

7. The liquid detergent composition of claim 2 wherein the alkali metal sulfate is sodium sulfate and wherein the inorganic phosphate builder is sodium tripolyphosphate.

8. The liquid detergent composition of claim 3 wherein the alkali metal sulfate is sodium sulfate and wherein the inorgnic phosphate builder is sodium pyrophosphate.

9. The liquid detergent composition of claim 3 wherein the alkali metal sulfate is sodium sulfate and wherein the inorganic phosphate builder is sodium tripolyphosphate.

10. The liquid detergent composition of claim 1 wherein the inorganic phosphate builder is present in an amount from about 8% to about 20% by weight of the composition; the alkali metal sulfate is present in an amount from about 5% to about 12% by weight of the composition; and the water is present in an amount from about 50% to about 65% by weight of the composition.

11. The liquid detergent composition of claim 2 wherein the inorganic phosphate builder is present in an amount from about 8% to about 20% by weight of the composition; the alkali metal sulfate is present in an amount from about 5% to about 12% by weight of the composition; and the water is present in an amount from about 50% to about 65% by weight of the composition.

12. The liquid detergent composition of claim 3 wherein the inorganic phosphate builder is present in an amount from about 8% to about 20% by weight of the composition; the alkali metal sulfate is present in an amount from about 5% to about 12% by weight of the composition; and the water is present in an amount from about 50% to about 65% by weight of the composition.

13. The liquid detergent composition of claim 10 wherein the alkali metal sulfate is sodium sulfate and wherein the inorganic phosphate builder is sodium pyrophosphate.

14. The liquid detergent composition of claim 10 wherein the alkali metal sulfate is sodium sulfate and wherein the inorganic phosphate builder is sodium tripolyphosphate.

15. The liquid detergent composition of claim 11 wherein the alkali metal sulfate is sodium sulfate and wherein the inorganic phosphate builder is sodium pyrophosphate.

16. The liquid detergent composition of claim 11 wherein the alkali metal sulfate is sodium sulfate and wherein the inorganic phosphate builer is sodium tripolyphosphate.

17. The liquid detergent composition of claim 12 wherein the alkali metal sulfate is sodium sulfate and wherein the inorganic phosphate builder is sodium pyrophosphate.

18. The liquid detergent composition of claim 12 wherein the alkali metal sulfate is sodium sulfate and wherein the inorganic phosphate builder is sodium tripolyphosphate.

19. The liquid detergent of claim 1 wherein Surfactant A is sodium alkyl ether sulfate where R has between in about 14 and about 16 carbon atoms and where $n$ has an average value between about 1 and about 6; and wherein R′ for Sufactant B has between about 11 and about 13 carbon atoms.

20. The liquid detergent of claim 2 wherein Surfactant A is sodium alkyl ether sulfate where R has between about 14 and about 16 carbon atoms and where $n$ has an average value between about 1 and about 6; and wherein R′ for Surfactant B has between about 11 and about 13 carbon atoms.

21. The liquid detergent of claim 3 wherein Surfactant A is sodium alkyl ether sulfate where R has between about 14 and about 16 carbon atoms and where $n$ has an average value between about 1 and about 6; and wherein R′ for Surfactant B has between about 11 and about 13 carbon atoms.

22. The liquid detergent of claim 10 wherein Surfactant A is sodium alkyl ether sulfate where R has between about 14 and about 16 carbon atoms and where $n$ has an average value between about 1 and about 6; and wherein R′ for Surfactant B has between about 11 and about 13 carbon atoms.

23. The liquid detergent composition of claim 19 wherein Surfactant A is sodium alkyl ether sulfate where R has between about 14 and about 16 carbon atoms and where $n$ has an average value of about 1; wherein R′ for Surfactant B has about 12 carbon atoms; wherein the amount of Surfactant A is from about 4% to about 6% by weight of the composition; wherein the amount of Surfactant B is from about 6% to about 8% by weight of the composition; wherein the builder is sodium tripolyphosphate in an amount from about 14% to about 16% by weight of the composition; wherein the alkali metal sulfate is sodium sulfate in an amount from about 7% to about 9% by weight of the composition.

24. The liquid detergent composition of claim 19 wherein Surfactant A is sodium alkyl ether sulfate where R has between about 14 and about 16 carbon atoms and where $n$ has an average value of about 1; wherein R′ for Surfactant B has about 12 carbon atoms; wherein the amount of Surfactant A is from about 4% to about 6% by weight of the composition; wherein the amount of Surfactant B is from about 9% to about 11% by weight of the composition; wherein the builder is sodium pyrophosphate in an amount from about 14% to about 16% by weight of the composition; wherein the alkali metal sulfate is sodium sulfate in an amount from about 5% to about 7% by weight of the composition.

25. The liquid detergent composition of claim 10 that also contains from about 1% to about 10% by weight of the composition of an amorphous water-insoluble hydrated compound of the formula $Na_x(xAlO_2 \cdot ySiO_2)$, wherein $x$ is a number from 1 to 1.2 and $y$ is 1, said amorphous compound being further characterized by a $Mg^{++}$ exchange capacity of from about 50 mg. eq. $CaCO_3$/g. to about 150 mg. eq. $CaCO_3$/g.

26. The liquid detergent composition of claim 10 that also contains from about 1% to about 10% by weight of the composition of a water-insoluble synthetic aluminosilicate ion exchange material of the formula $Na_z.[AlO_2)_z.(SiO_2)_y]xH_2O$, wherein $z$ and $y$ are integers of at least 6; the molar ratio of $z$ to $y$ is in the range from 1.0 to about 0.5, and $x$ is an integer from about 15 to about 264; said aluminosilicate ion exchange material laving a particle size diameter from about 0.1 micron to about 100 microns; a calcium ion exchange capacity of at least about 200 mg. eq./g.; and a calcium ion exchange rate of at least about 2 grans/gallon/minute/gram.

27. The liquid detergent composition of claim 10 that also contains from 1% to about 3% by weight of the composition of a glassy phosphate of the formula $$(M_2O)_x(P_2O_5)_y$$

wherein $y$ is from about 5 to about 50 and the ratio of $y:x$ is from about 1:1 to about 1:15 and M is an alkali metal.

28. The process of preparing a liquid detergent composition having as components:

a. surfactant in an amount from about 7% to about 25% by weight of the composition, said surfactant consisting of:

i. Surfactant A selected from the group consisting of sodium alkyl sulfate $ROSO_3Na$ and sodium alkyl ether sulfate $R(OC_2H_4)_n OSO_3Na$, where R is an alkyl chain having from about 12 to about 20 carbon atoms and where $n$ has an average value from about 1 to about 12; and ii. Surfactant B consisting of sodium alkyl benzene sulfonate $R'\phi SO_3Na$ where R' is a branched alkyl chain having from about 9 to about 15 carbon atoms;

wherein the amount of Surfactant A is between about 3% and about 25% by weight of the composition;

b. sodium pyrophosphate in an amount from about 6% to about 25% by weight of the composition;

c. alkali metal sulfate in an amount from about 3% to about 20% by weight of the composition as stabilizing electrolyte; and d. water in an amount from about 40% to about 75% of the composition;

wherein said process comprises mixing all components at a temperature from about 70° F. to about 110° F.

* * * * *

UNITED STATES PATENT OFFICE

CERTIFICATE OF CORRECTION

Patent No. 4,018,720 Dated April 19, 1977

Inventor(s) Stephen Price Lengyel et al.

It is certified that error appears in the above-identified patent and that said Letters Patent are hereby corrected as shown below:

The title should read:

"LAUNDRY DETERGENT COMPOSITIONS IN EMULSION/SUSPENSION FORM"

In column 2, line 2, the word reading "dispense" should read -- disperse --.

In column 5, lines 59-60, the formula reading "$R'\phi\lambda SO_3Na$" should read -- $R'\phi SO_3Na$ --.

In column 11, line 32, the unit reading "mg. eq. g." should read -- mg. eq./g. --.

UNITED STATES PATENT OFFICE

CERTIFICATE OF CORRECTION

Patent No. 4,018,720 Dated April 19, 1977

Inventor(s) Stephen Price Lengyel et al.

It is certified that error appears in the above-identified patent and that said Letters Patent are hereby corrected as shown below:

After Table I which concludes at column 17, line 4, the following should be inserted:

"Key to Table I:

a. $C_{14-15}$ $AE_1S$ made from Oxo alcohol
b. $C_{12}$ ABS, branched chain
c. Emphos PS-236 (Trademark, Witco Chemical Company)
d. Polyethylene glycol having a molecular weight of approximately 6000
e. Colloidal silica (Trademark, E. I. duPont de Nemours)
f. 2.0 ratio $SiO_2/Na_2O$
g. Carboxymethyl cellulose
h. Trademark, FMC Corporation, for a glassy phosphate, sodium salt, containing 21 phosphorus atoms per molecule."

Signed and Sealed this nineteenth Day of July 1977

[SEAL]

Attest:

RUTH C. MASON
Attesting Officer

C. MARSHALL DANN
Commissioner of Patents and Trademarks